US005187885A

United States Patent [19]

Murphy

[11] Patent Number: 5,187,885

[45] Date of Patent: Feb. 23, 1993

[54] GOLF SHOE INSERT

[76] Inventor: John T. Murphy, 1979-H NW 4th Ave., Boca Raton, Fla. 33432

[21] Appl. No.: 555,938

[22] Filed: Jul. 19, 1990

[51] Int. Cl.[5] ..... A43B 5/00; A43B 13/38

[52] U.S. Cl. ..... 36/127; 36/43

[58] Field of Search ..... 36/43, 44, 71, 127

[56] References Cited

U.S. PATENT DOCUMENTS

| | | | |
|---|---|---|---|
| 1,818,730 | 8/1931 | Mattison | 36/43 |
| 2,081,474 | 5/1937 | Burns | 128/615 |
| 2,681,515 | 6/1954 | Frese, Jr. | 128/619 |
| 2,847,769 | 8/1958 | Schlesinger | 36/71 |
| 3,084,695 | 4/1963 | O'Donnell | 128/615 |
| 4,541,186 | 9/1985 | Mulvihill | 36/44 |
| 4,955,148 | 9/1990 | Padilla | 36/43 |

FOREIGN PATENT DOCUMENTS

| | | | |
|---|---|---|---|
| 2634701 | 2/1978 | Fed. Rep. of Germany | 36/71 |
| 3723516 | 1/1989 | Fed. Rep. of Germany | 36/43 |

*Primary Examiner*—Paul T. Sewell
*Assistant Examiner*—Marie D. Patterson
*Attorney, Agent, or Firm*—Joseph Zallen

[57] ABSTRACT

This invention comprises generally an integral insert for a golf shoe having several raised protuberances extending upwardly from a base shaped to fit on and cover the inner sole of the shoe. The protuberances are resilient and can be made from cellular plastic or elastomer, or can be molded integrally with the base. One protuberance tapers inwardly from the outer edge of the insert and extends from the heel to the end of the toes, and another protuberance tapers inwardly from the inner edge in the middle section.

1 Claim, 1 Drawing Sheet

GOLF SHOE INSERT

BACKGROUND OF THE INVENTION

This invention relates to a golf shoe insert which helps the user maintain desired positions when swinging a golf club.

One object of this invention is to provide a golf shoe insert which helps stabilize the golfer's position during a swing.

Other objects and advantages of this invention will be apparent from the description and claims which follow taken together with the appended drawings.

SUMMARY OF THE INVENTION

This invention comprises generally an integral insert for a golf shoe having several raised protuberances extending upwardly from a base shaped to fit on and cover the inner sole of the shoe. The protuberances are resilient and can be made from cellular plastic or elastomer, as for example polyurethane foam or the like. By suitable molding techniques the protuberances can be formed from the base itself without adding the foam material illustrated in the accompanying drawings. In such case the base should incorporate an upper layer of resilient material.

The heel section of the base is flat. On the outer edge of the insert is a resilient protuberance which tapers inwardly from the outer edge of the insert towards the center of the base and extends longitudinally from the inner end of the heel section to the outer end of the toe section and preferably fans out at the toe section to cover the third, fourth and fifth metatarsal joints portions.

A second resilient protuberance is provided which tapers inwardly from the inner edge of the insert and extends longitudinally from the inner end of the heel section to the inner end of the toe section. The protuberances are separate portions from each other so that there is a thin portion of the base between their inner edges. The approximate maximum height of the protuberances is about one-quarter inch. If desired, a resilient heel cup can be used with the insert or molded with the insert. Where desired, a sock lining fabric can be provided for the outer surfaces of the insert. The resilient protuberances can be of varying durometer.

SPECIFIC EXAMPLE OF INVENTION

Figure 1:
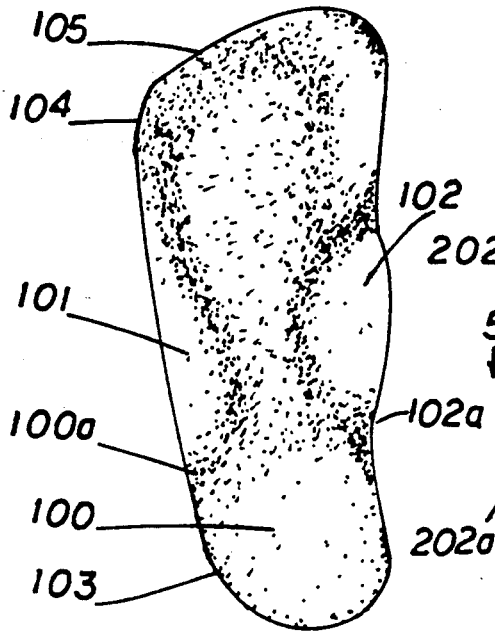
FIG. 1 is a top view of a shoe insert for the left foot made in accordance with this invention.
Figure 2:
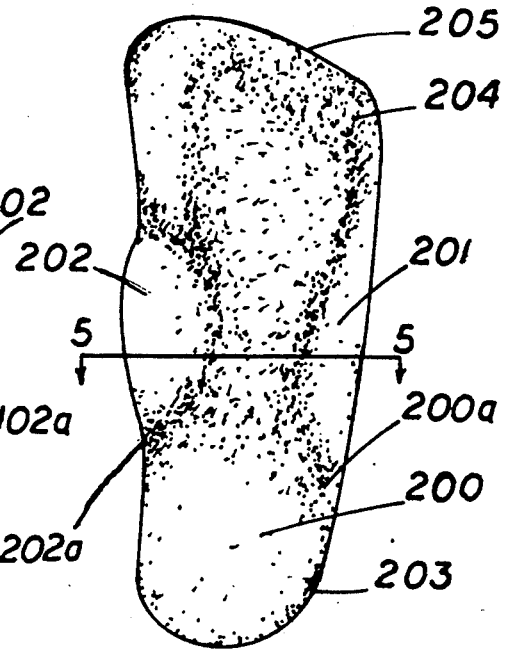
FIG. 2 is a top view of a shoe insert for the right foot made in accordance with this invention.
Figure 3:
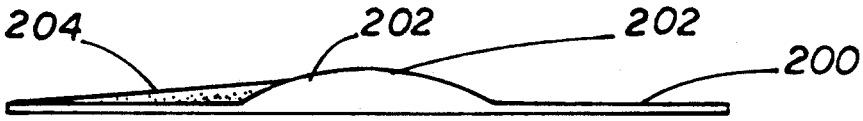
FIG. 3 is a left side view of FIG. 2.
Figure 4:
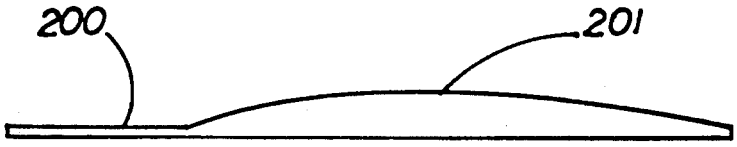
FIG. 4 is a right side view of FIG. 2.
Figure 5:
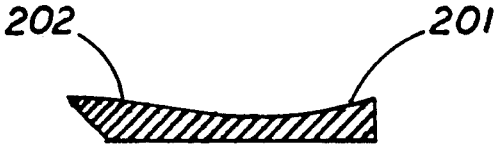
FIG. 5 is a cross-section along 5—5 of FIG. 2.

Referring now to the drawings, an example of this invention is shown. A thin, flat base 100, 200 is provided which is shaped so as to lie on the innersole of the golf shoe. The base has heel, middle and toe sections with resilient foam protuberances extending inwardly from the edges. The heel section 103, 203, has no protuberance and is thus flat.

Resilient protuberance 101, 201 extends longitudinally from the front end of heel section 103, 203 to the front end 105, 205 of the toe section, tapers to the base 100, 200 at each of its ends, has its maximum height at the outer edge 100*a*, 200*a* of the base, and extends in a tapering fashion inwardly from outer edge 100*a*, 200*a* to approximately the center of the middle section, widening at the toe section to cover the third, fourth and fifth metatarsal joints portions 104, 204 of the base.

Resilient protuberance 102, 202 tapers to the base at both ends, extends longitudinally from the inner end of the heel section 103 to the inner end of the toe section and tapers transversely inwardly from the inner edge 102*a*, 202*a*, where its height is greatest, to the center portion of the base.

The insert of this invention is intended to keep the weight on the instep or balls of the feet. When a person turns, the weight shifts. The insert of this invention helps stabilize. The heel is lower so that there is weight on the heel on the back swing. The outer protuberances 101 and 201 permit the foot to roll on the outside middle. There is approximately a one-quarter height increase on the outer lifts 101 and 201.

In comparison with the prior art, nothing is attached to the outside sole area of the shoe. The protuberances provided in the integral insert of this invention provide means for forcing the user into the desired positions and attitudes that are beneficial in playing golf. Thus, the insert in the left shoe thrusts the weight back onto the left heel so that it is firmly on the ground during impact.

Experts in the game of golf point out that there are proper ways for moving the hands and feet when swinging at the ball. For example, Vivien Saunders recommends balance of the left heel and right toe. Jack Nicklaus points out that proper footwork begins at address. The stance must be narrow enough to move with ease and wide enough to provide a stable base with longer clubs. The present invention gives great assistance to proper stance and posture.

I claim:

1. An integral insert (100) for a golf shoe having an outer edge (100*a*, 200*a*) corresponding to the outside portion of the user's foot and an inner edge (102*a*, 202*a*) corresponding to the inside portion of the user's foot comprising:

(a) a base member (100, 200) shaped to fit over the inner sole of the shoe and having a flat heel section, a middle section and a toe section;

(b) a first resilient raised portion (101, 201) tapering inwardly from the outer edge (100*a*, 200*a*) of the insert and extending longitudinally from the inner end of the heel section, through the middle section, to the forward edge of the toe section, widening so as to cover the toe portions of the third, fourth, and fifth metatarsal joints; and (c) a second resilient raised portion (102, 202) in the middle section of the base member, tapering inwardly from the inner edge (102*a*, 202*a*) of the insert and extending longitudinally from the inner end of the heel section to the inner end of the toe section.

* * * * *